US005338091A

United States Patent [19]

Miller

[11] Patent Number: 5,338,091

[45] Date of Patent: Aug. 16, 1994

[54] WELT LOCK FURNITURE CONSTRUCTION

[76] Inventor: Elmo E. Miller, 8201 16th St., Apt. 1126, Silver Spring, Md. 20910

[21] Appl. No.: 788,945

[22] Filed: Nov. 7, 1991

[51] Int. Cl.[5] ..... A47C 27/00

[52] U.S. Cl. ..... 297/218; 297/226; 297/452.56

[58] Field of Search ..... 297/452, 218, 445, 457, 297/440, 441, 219, 226, 229; 428/596, 603

[56] References Cited

U.S. PATENT DOCUMENTS

| | | | |
|---|---|---|---|
| 1,867,313 | 7/1932 | Gaines, Jr. | 428/596 X |
| 2,242,794 | 5/1941 | Puschner et al. | 428/596 X |
| 3,904,380 | 9/1975 | Smith | 428/596 X |
| 4,370,002 | 1/1983 | Koepke | 297/218 X |

FOREIGN PATENT DOCUMENTS

| | | | |
|---|---|---|---|
| 2915558 | 10/1979 | Fed. Rep. of Germany | 297/218 |
| 3618057 | 12/1986 | Fed. Rep. of Germany | 297/218 |
| 3632278 | 4/1987 | Fed. Rep. of Germany | 297/218 |
| 3732836 | 12/1988 | Fed. Rep. of Germany | 297/218 |
| 1240875 | 8/1960 | France | 297/226 |
| 317481 | 11/1969 | Sweden | 297/218 |

*Primary Examiner*—Laurie K. Cranmer

[57] ABSTRACT

Webbing is attached to a furniture frame by a hem and welting, which are laid in a channel and locked in with a strip that is slipped under the webbing and into the channel. This arrangement also holds the locking strip in place. The strip is removable so the webbing can be cleaned or replaced. The channel can be formed by welding flexible stock to a steel frame of any shape.

12 Claims, 2 Drawing Sheets

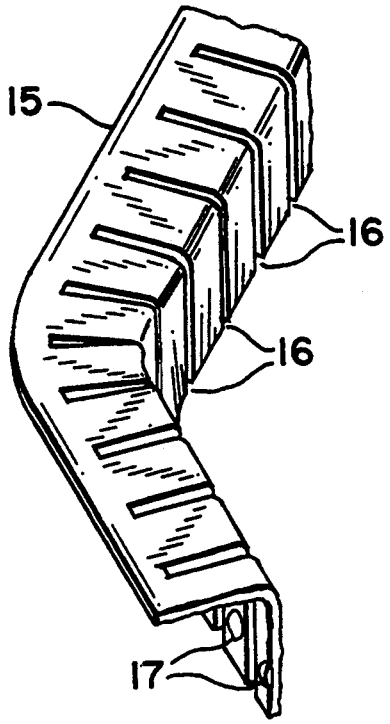
FIG. 6
FIG. 7
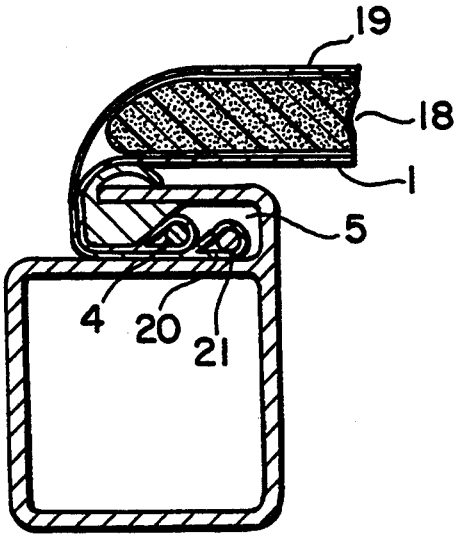
FIG. 8
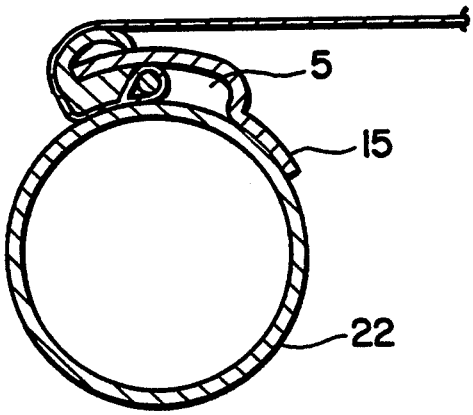

WELT LOCK FURNITURE CONSTRUCTION

BACKGROUND OF THE INVENTION

This invention relates to furniture that supports a person by webbing slung on a frame, and more particularly to an improved means for attaching the webbing to the frame.

Slung furniture is not only economical, but also comfortable because the fabric flexes to conform to one's body. A common way of attaching the webbing is by means of a hem and welting that are inserted into a channel in the frame; the hem is locked in because the channel opening is narrower than the welting. This limits design because the hem and welting must be inserted from the end of the channel. In particular, the webbing can not be attached around its entire perimeter. It would be better if one could simply lay hem and welting in a channel, and somehow lock them in.

One approach is to use welting that is not round, so it can be placed in the channel then turned to resist being pulled out. Lovell (1930) and Wisner (1930) disclose essentially the same welt lock system that uses double round or oblong welting in the hem of upholstery. This holds it in a specially shaped channel because the welting comes to bear on a front wall of that channel. Similarly, Hoven (1951) describes an oval or flat spring in a hem that holds the edge of upholstery within an oval channel. With this kind of arrangement, however, the hem may fall out of the channel when there is slack in the upholstery, and such systems are not intended to support the weight of a person.

The present invention uses a better approach, using a locking strip to secure hem and welting in a channel. The locking arrangement is a form of synergy, in which the locking strip and the other elements hold each other securely in position.

Only a few patents involve welting and any sort of locking strip, and these locking strips are quite different from the present invention. Austin (1956) discloses a method in which a hem and welting are laid in a channel, then locked in by a stiff block that is forced into the channel "by pounding or otherwise". The block is held in place by pressure, friction, and a ridge on the block that engages a notch in the side of the channel. There is no provision for removal of the block. Babbs (1974) discloses a U-shaped extrusion that is "welded" by radio frequency waves to the edge of fabric, hooked over one edge of a channel, and held in place by a second extrusion that is forced into the channel. The second extrusion has cavities to provide the necessary compressibility. This method is appropriate only for light duty applications, because the welding is not likely to support the weight of a person. Koepke (1983) discloses a strip that is stapled to one edge of a channel, to provide a tight fit when a hem and welting are subsequently forced into the channel. Since Hoepke's strip is placed first it cannot truly block removal of the hem and welting. None of these systems involves a locking strip that is placed in the channel under the webbing after the hem and welting are inserted, as does the present invention, nor do they provide any means for removal of the webbing for cleaning or replacement.

One object of the present invention is slung furniture that supports the weight of a person by means of a hem and welting that can be laid in a channel, without having to insert them from the end of the channel. Another object is to lock the hem and welting in a channel with a locking strip in an arrangement where these elements hold each other neatly in position. Another object is a means to install and remove the locking strip, so that the webbing can be cleaned, repaired, or replaced. Finally, another object is to make the channel with flexible stock welded to a frame of standard steel tubing.

SUMMARY OF THE INVENTION

Webbing is attached to a furniture frame by means of a hem and welting, which are laid in a channel on the frame, and locked in with a strip inserted into the channel, under the webbing. The strip is held securely in place and neatly concealed by the webbing and welting. The webbing can be removed for cleaning, repair, or replacement. The channel can be formed of flexible stock welded to a step, frame.

DESCRIPTION OF THE DRAWINGS

FIG. 6 is a perspective view of flexible stock for channels;

FIG. 7 is a sectional view of the invention with padding and upholstery cloth, from the same viewpoint as FIG. 2;

FIG 8 is a sectional view of the invention using round tubing, from the same viewpoint as FIG. 2.

DETAILED DESCRIPTION

Figure 1:
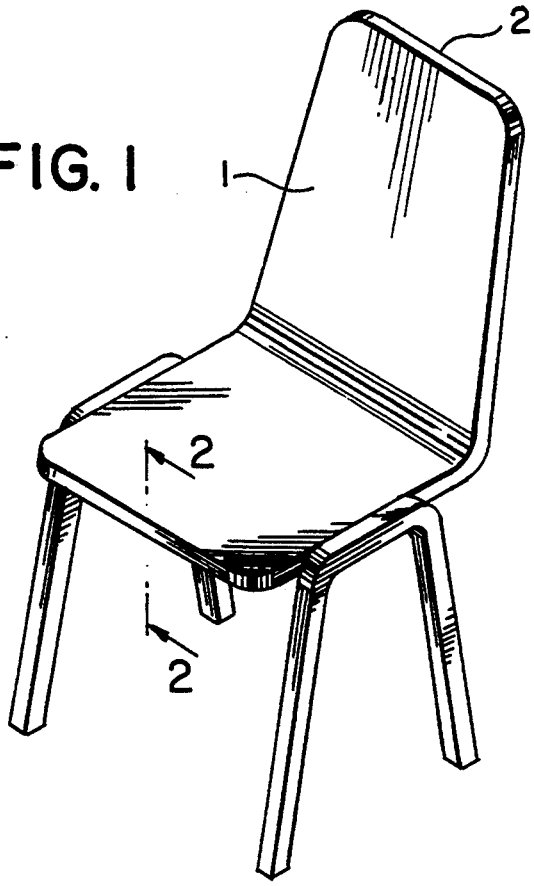
FIG 1 is a perspective view of a typical chair constructed according to this invention.

A chair exemplifying this invention is shown in FIG. 1. Webbing 1 is attached around its perimeter to a tubular frame 2.

Figure 2:
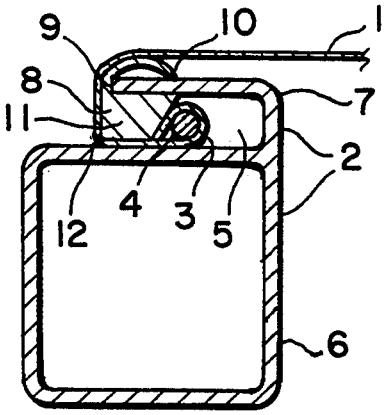
FIG. 2 is a sectional view taken along line 2—2 of FIG. 1.

The means of attachment is shown in FIG. 2. This is the preferred embodiment. The webbing 1 has a hem 3 and welting 4, which are tucked into a channel 5 in the frame 2. The frame 2 comprises a base frame 6 and an external projection 7 bent over so that the channel 5 faces away from the webbing 1. A locking strip 8 is placed under the webbing 1 and over the edge 9 of the channel 5 to lock in the hem 3 and welting 4. (The method of installation is described below.) When there is weight on the webbing 1 it pulls on the hem 3 and welting 4, and the webbing 1 presses the locking strip 8 onto the edge 9 and keeps it in place. The narrowness of the channel 5 keeps the locking strip 8 and welting 4 in order. A flap 10 extending from the body 11 stabilizes the locking strip 8 in the channel 5 so that it can only be removed by deliberate effort. The flap 10 also provides a rounded contour that improves appearance and reduces wear on the webbing 1. Appearance is neat because the locking strip 8 is concealed, and it can not be removed casually by children or mischievous adults.

The body 11 of the locking strip 8 also has a ridge 12 to keep the webbing 1 pressed neatly against the surface of the base frame 6. To accommodate curves in the channel 5, the hem 3 may be puckered over the welting 4, and the welting 4 may be segmented.

Figure 3:
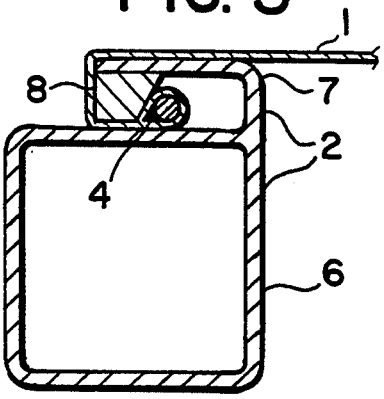
FIG. 3 is a sectional view of an alternative embodiment of the invention, from the same viewpoint as FIG. 2.

FIG. 3 shows another embodiment using a locking strip 8 without the flap 10. A test was conducted with this minimal configuration, using welting 4 of 0.105 inch diameter extruded nylon line and a locking strip 8 of two-wire electrical cord. This was quite strong enough to support the weight of an adult. Test results were also satisfactory when the locking strip 8 was made of the same kind of nylon line as the welting 4. However, in this embodiment the locking strip 8 can peeled out too easily, so in production the locking strip 8 should have the flap 10 to keep it in position.

Figure 4:
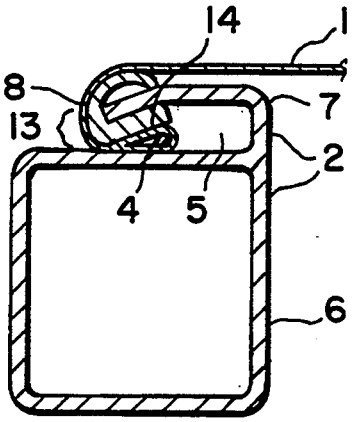
FIG 4 is a sectional view of another embodiment of the invention, from the same viewpoint as FIG. 2.

In another embodiment of the invention (FIG. 4) the channel 5 is narrow at its opening 13 but wider inside. The opening 13 is just wide enough to admit either the welting 4 or the locking strip 8, but not both together. After installation the welting 4 bears on the underside 14 of the locking strip 8 and the surface of the base frame 6. In this embodiment the opening 13 does not have to face directly away from the webbing 1 because the welting 4 is wedged in, and pulling on the webbing 1 from any direction only makes it tighter. On the other hand, this embodiment requires a stronger channel 5 because of the wedging action, and the channel 5 is bulkier.

Figure 5:
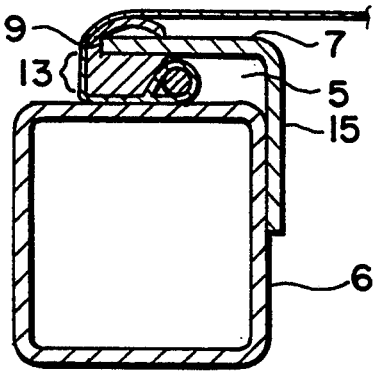
FIG. 5 is a sectional view of the invention constructed from stock tubing and angle stock, from the same viewpoint as FIG. 2.

The external projection 7 can be L-shaped angle stock 15, which is attached to a base frame 6 by welding, riveting or otherwise (FIG. 5). The base frame 6 may be metal tubing, wood or other material. In the preferred embodiment the angle stock 15 has slots 16 (FIG. 6) so that it can be bent in any shape to conform to a tubular base frame 6. A welding compound 17 is deposited on the joining surfaces of the stock 15 during its manufacture to facilitate welding. Such stock 15 is welded to a steel base frame 6 by clamping them together and heating. Alternatively, they could be welded by the process that is used to weld tin cans, with high frequency high voltage pulses. The width of opening 13 of the channel 5 may be set during welding by placing a shim of the desired thickness between the channel edge 9 and the base frame 6. This provides a means of compensation for thickness of fabric and number of layers.

Foam padding 18 and upholstery cloth 19 may be added (FIG. 7), and an additional hem 20 and welting 21 may be used for mounting. The channel 5 is deep enough for the extra welting 21 and both weltings 4 & 21 are kept in order. Over much of the perimeter the upholstery cloth 19 may be sewn to the webbing 1 and the extra welting 21 eliminated.

Still another embodiment of the invention uses round tubing 22 (FIG. 8). The stock 15 for the channel 5 is modified accordingly.

A handy method for installation and removal of the locking strip 8 is needed, not only for manufacture, but also to allow owners to clean, repair, or replace the webbing 1.

During installation the hem 3, welting 4 and locking strip 8 are first pressed by hand into the channel 5 for a ways; this is easy to do when the edge 9 is not yet covered by the webbing 1.

The locking strip may be removed by inserting a removing tool under the flap 10 at one end the locking strip 8, then pushed and twisted to pry the locking strip 8 out of the channel 5, By grasping the free end the entire locking strip 8 is peeled out of the channel 5.

I claim:

1. Slung furniture comprising:

a frame;

webbing that supports the weight of a person;

a hem in said webbing;

a welting in said hem;

a channel having an opening in said frame within which said hem and said welting are laid, which channel is oriented so that one edge is at least partially covered by said webbing when said slung furniture is used;

a flexible, removable, locking strip inserted into said channel between said webbing and the side of said channel that is adjacent to said edge, and between said welting and the opening of said channel;

wherein a gap between said locking strip and the channel wall opposite said edge is too narrow for said welting to be pulled through it even though said welting and said locking strip are from a person being supported by said webbing, and wherein said tension keeps said locking strip in place, so as to block removal of said and said hem from said channel and wherein said webbing can be removed from the frame when said locking strip is selectively removed from said channel.

2. Slung furniture as defined in claim 1, in which said welting and said locking strip are kept in sequence by the narrowness of said channel and in which the opening of said channel faces away from the direction of pull from said webbing.

3. Slung furniture as defined in claim 2, in which said frame comprises a base frame and an external projection attached to said base frame, which external projection is bent toward said base frame to form said channel.

4. Slung furniture as defined in claim 3, in which said frame is fabricated from stock comprising a tube and said external projection attached thereto.

5. Slung furniture as defined in claim 3, in which said channel is formed by fixedly attaching angle stock for said external projection to said base frame.

6. Slung furniture as defined in claim 1; in which said locking strip further comprises a flap extending laterally from its surface to cover said edge; in which said channel is wider inside than at said opening; and in which said locking strip is shaped so that said welting becomes wedged between its side and the side of said channel opposite said edge when there is a load on said webbing.

7. Slung furniture as defined in claim 1, further comprising padding and upholstery cloth on top of said webbing.

8. Slung furniture as defined in claim 7, in which said upholstery cloth has its own hem and welting that are also retained in said channel by said locking strip.

9. Slung furniture as defined in claim 1, wherein said frame comprises a base frame and stock attached thereto to form said channel, which stock is a strip of material with at least one bend parallel to its edges and with slots at intervals, which slots each extend from one edge through said bend and almost to the opposite edge.

10. Slung furniture as defined in claim 9, further comprising a welding compound deposited on the surfaces of said stock where it may be joined with said base frame.

11. Slung furniture as defined in claim 1, in which said flexible locking strip further comprises:

a body that fits into said channel between said webbing and the side adjacent to said edge; and a flap extending laterally from a surface of said body around said edge of said channel.

12. Slung furniture as defined in claim 11, in which said flexible locking strip further comprises a ridge on said body where said webbing meets a surface of said frame near the opening of said channel.

* * * * *

UNITED STATES PATENT AND TRADEMARK OFFICE

CERTIFICATE OF CORRECTION

PATENT NO. : 5,338,091
DATED ; August 16, 1994
INVENTOR(S) : Elmo E. Miller

It is certified that error appears in the above-identified that said Letters Patent is hereby corrected as shown below:

Column 4, claim 1, line 15, after " are " insert --tensioned--

Signed and Sealed this

Fifteenth Day of August, 1995

*Attest:*

Bruce Lehman

BRUCE LEHMAN

*Attesting Officer*

*Commissioner of Patents and Trademarks*